US007124900B2

(12) United States Patent
Hu

(10) Patent No.: US 7,124,900 B2
(45) Date of Patent: Oct. 24, 2006

(54) HANGER FOR TOOL

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 106 days.

(21) Appl. No.: 10/978,590

(22) Filed: Nov. 1, 2004

(65) Prior Publication Data

US 2005/0116130 A1 Jun. 2, 2005

(30) Foreign Application Priority Data

Nov. 28, 2003 (TW) ..... 92133468 A

(51) Int. Cl.
*A47F 7/00* (2006.01)

(52) U.S. Cl. ..... 211/70.6; 206/349; 206/378; 248/551

(58) Field of Classification Search ..... 248/551, 248/553, 317, 314, 309.1; 211/70.6; 206/375, 206/377, 378, 349
See application file for complete search history.

(56) References Cited

U.S. PATENT DOCUMENTS 5,484,056 A * 1/1996 Wood ..... 206/349
5,740,911 A * 4/1998 Chou ..... 206/378
6,032,797 A * 3/2000 Kao ..... 206/378
6,378,700 B1 * 4/2002 Tong ..... 206/376
6,581,894 B1 * 6/2003 Tong ..... 248/314
6,634,501 B1 * 10/2003 Su et al. ..... 206/378
6,672,555 B1 * 1/2004 Chang ..... 248/317
6,883,664 B1 * 4/2005 Lee ..... 206/349
2005/0230587 A1 * 10/2005 Yang ..... 248/314

FOREIGN PATENT DOCUMENTS

TW 510289 11/2002

* cited by examiner

*Primary Examiner*—Ramon O Ramirez
(74) *Attorney, Agent, or Firm*—Alan D. Kamrath; Nikolai & Mersereau, P.A.

(57) ABSTRACT

A hanger is disclosed for a tool in the form of a socket and that includes a recess. The hanger includes a board, two locking elements extending from the board and a key located between the locking elements. The board includes an aperture so that it can be hung on an object secured to a wall. The key is moved between a non-locking position and a locking position. In the non-locking position, the key allows the locking elements to be biased toward each other so that they can be inserted in the recess of the socket. In the locking position, the key prevents biasing of the locking elements toward each other so that they cannot be pulled from the recess of the socket.

20 Claims, 10 Drawing Sheets

HANGER FOR TOOL

BACKGROUND OF INVENTION

1. Field of Invention

The present invention relates to a hanger for a tool.

2. Related Prior Art

Referring to FIG. 10, a conventional hanger 101 is provided for a tool 120. The tool 120 includes a hollow portion 121 and a solid portion 122. The hanger 101 includes a board 110, an aperture 111 defined in the board 110 and a threaded portion 113 extending from the board 110 opposite to the aperture 111. The diameter of the threaded portion 113 is marginally larger than the internal diameter of the tool 120. The threaded portion 113 is elastic so that it can be driven into the hollow portion 121. Thus, the tool 120 is attached to the hanger 101. With the aperture 111, the hanger 101 and the tool 120 can be hung on a nail hammered into a wall. However, the tool 120 is not locked to the hanger 101. The tool 120 can be stolen when displayed for sale. Moreover, the tool 120 often escapes from the hanger 101 during transportation.

The present invention is therefore intended to obviate or at least alleviate the problems encountered in the prior art.

SUMMARY OF INVENTION

According to the present invention, a hanger is provided for a tool. The tool includes a recess. The hanger includes a board, two locking elements extending from the board and a key located between the locking elements. The board includes an aperture so that it can be hung on an object secured to a wall. The key is moved between a non-locking position and a locking position. In the non-locking position, the key allows the locking elements to be biased toward each other so that they can be inserted in the recess of the tool. In the locking position, the key prevents biasing of the locking elements toward each other so that they cannot be pulled from the recess of the tool.

The primary advantage of the hanger of the present invention is its ability to lock the tool.

Other objects, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
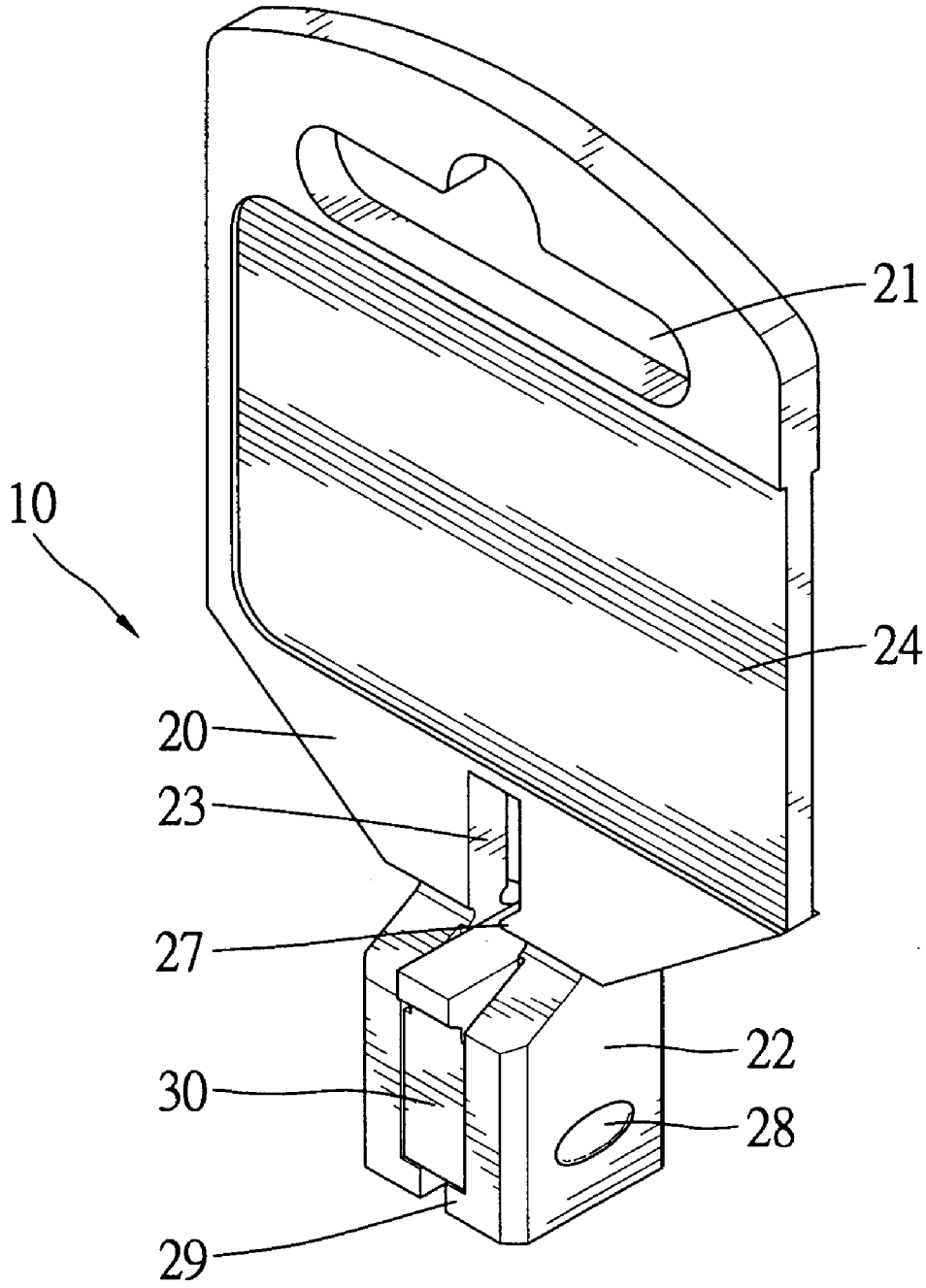
FIG. 1 is a perspective view of a hanger according to a first embodiment of the present invention.

Referring to the drawings, according to the present invention, a hanger 10 is provided for a socket 40. The socket 40 includes a square recess 41 for receiving a square insert extending from a wrench and a hexagonal recess 43 for receiving a fastener such as a nut or a head of a bolt. A groove 42 extends on the wall of the square recess 41 for receiving two detents extending from the square insert.

Figure 2:
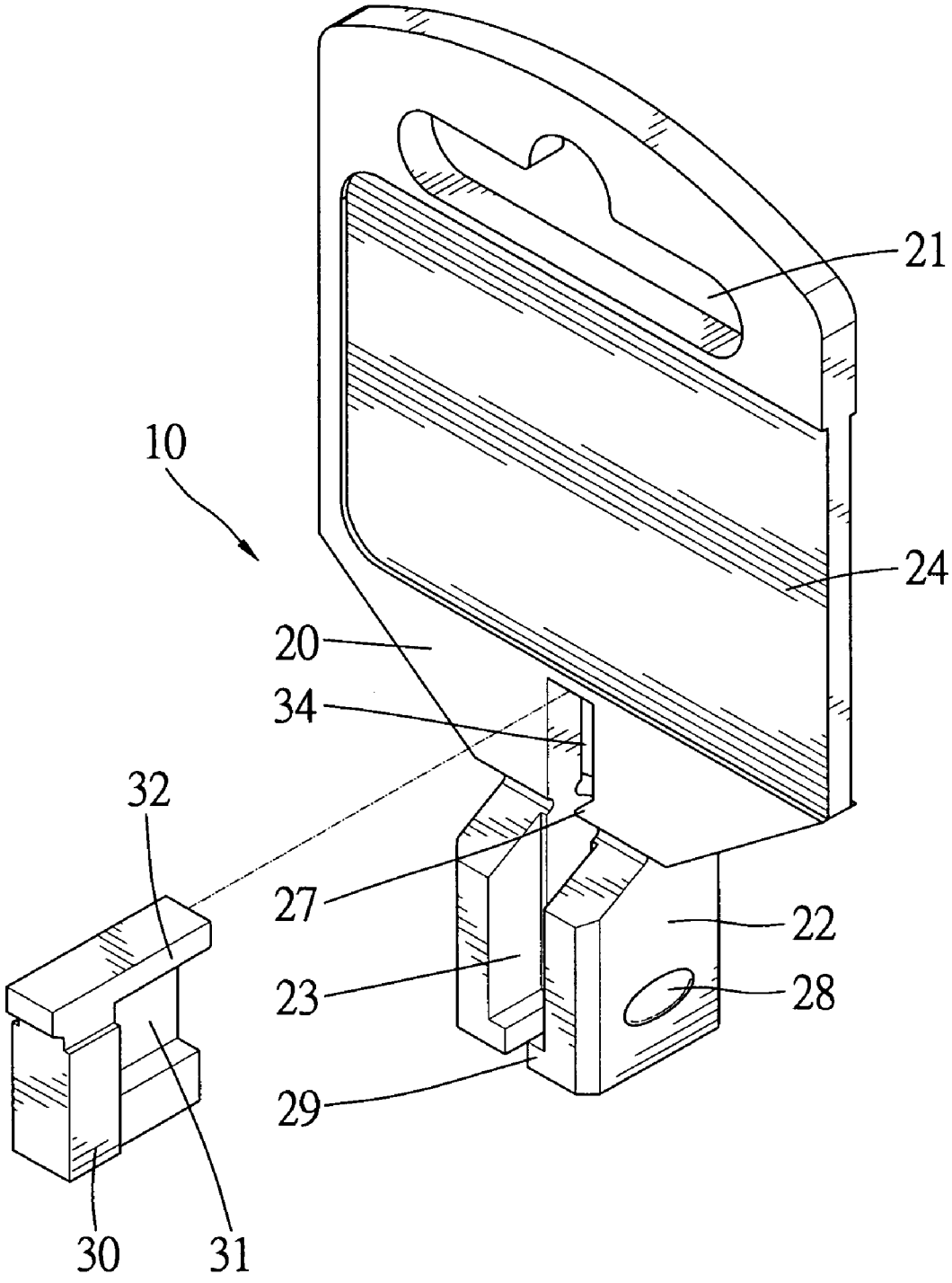
FIG. 2 is an exploded view of the hanger shown in FIG. 1.

Referring to FIGS. 1 and 2, according to a first embodiment of the present invention, a hanger 10 includes a board 20, two locking elements 22 and a key 30.

The board 20 includes an aperture 21 so that the board 20 can be hung on a nail or a hook secured to a wall. The board 20 includes a shallow recess 24 on a front face for receiving a sticker or a tag. The board 20 includes a slit 34 opposite to the aperture 21. A wedge 27 is formed on one of two edges by the slit 34.

The locking elements 22 are two parallel tabs separated from each other by a slit 23 communicated with the slit 34. Each locking element 22 includes a boss 28 on an internal side and a stop 29 on an internal side.

The key 30 includes a recess 31 on a side, an upper beam 32 above the recess 31 and a lower beam 33 below the recess 31.

Figure 3:
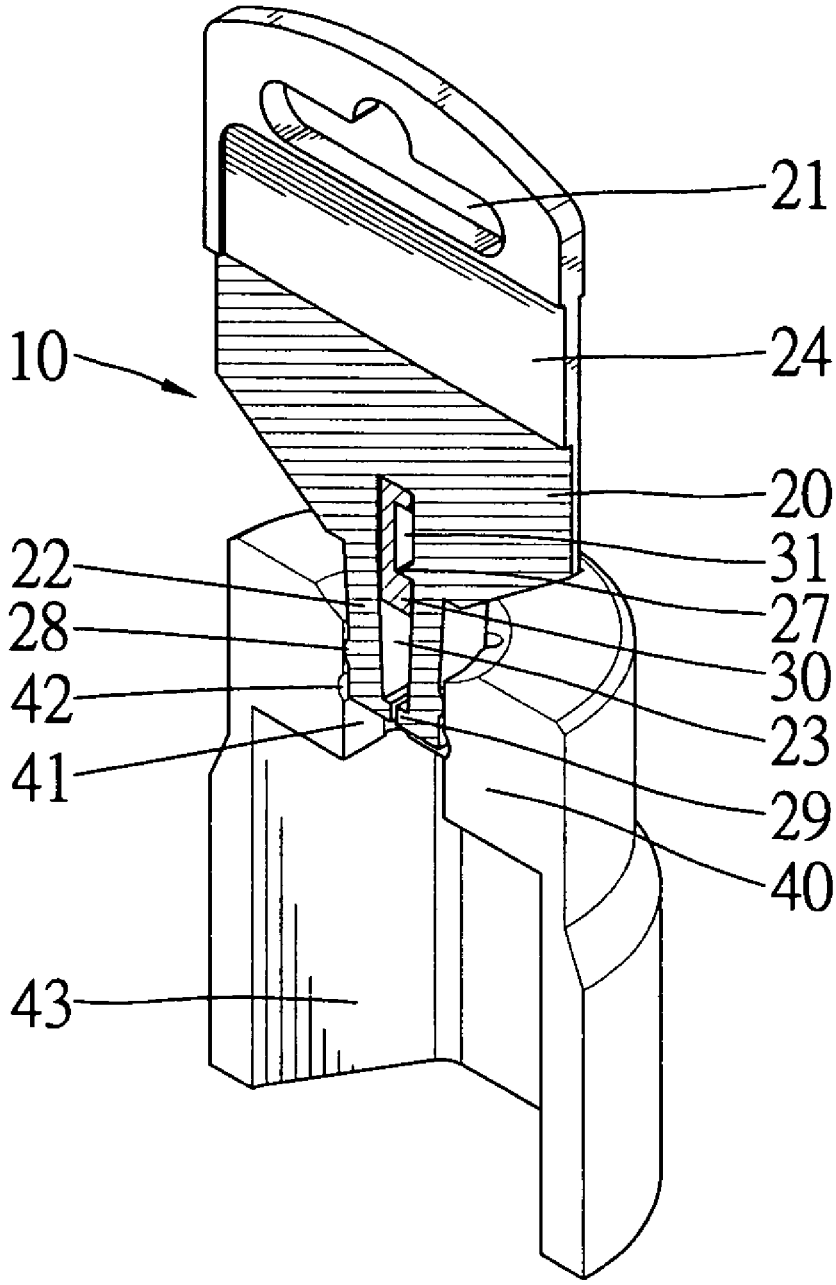
FIG. 3 is a cut-away view of a socket and the hanger shown in FIG. 1.

Referring to FIG. 3, the key 30 is in a non-locking position. The upper beam 32 is put in an upper end of the slit 34 and the lower beam 33 is put in an upper end of the slit 23. The locking elements 22 can be biased toward each other. Thus, the locking elements 22 can be inserted in the square recess 41. The locking elements 22 contact two opposite walls of the square recess 41.

Figure 4:
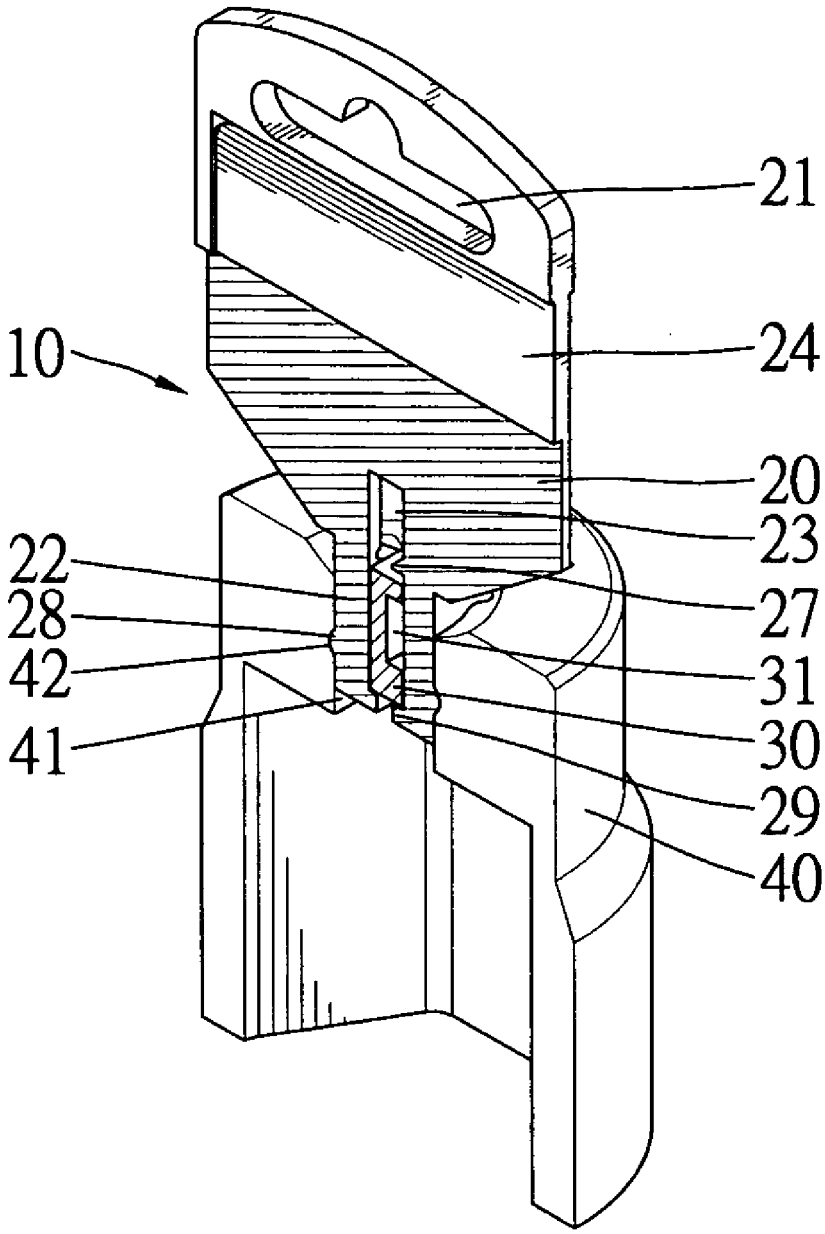
FIG. 4 is similar to FIG. 3 but shows the hanger in a locking position.
Figure 5:
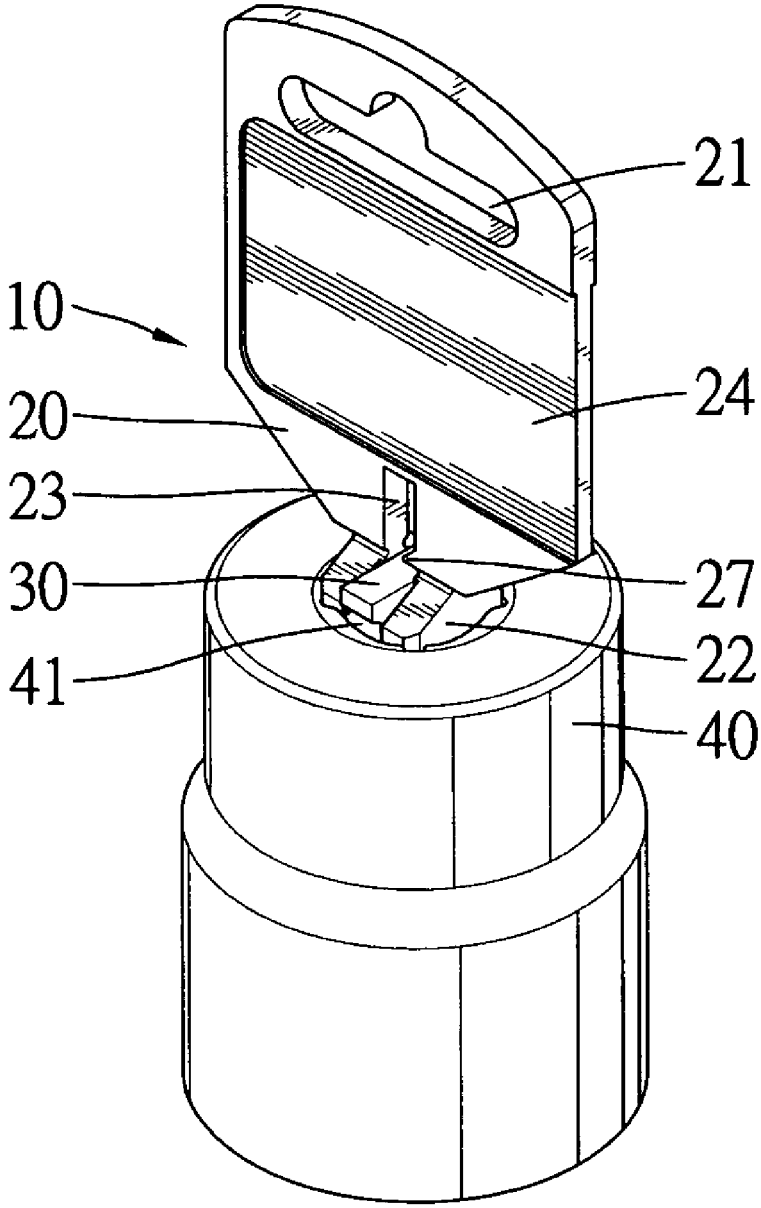
FIG. 5 is a perspective view of the socket and hanger shown in FIG. 4.

Referring to FIGS. 4 and 5, the locking elements 22 are completely inserted in the square recess 41. The bosses 28 are put in the groove 43. The key 30 is moved to a locking position. Beyond the wedge 27, the upper beam 32 is moved to the upper end of the slit 23. The upper beam 32 is kept in the upper end of the slit 23 by the wedge 27. The lower beam 33 is moved to the lower end of the slit 23 accordingly. The locking elements 22 cannot be biased toward each other. The bosses 28 are kept in the groove 43 so that the socket 40 is locked to the hanger 10. The lower beam 33 is restrained by the stops 29 so that the key 30 is retained between the locking elements 22.

Figure 6:
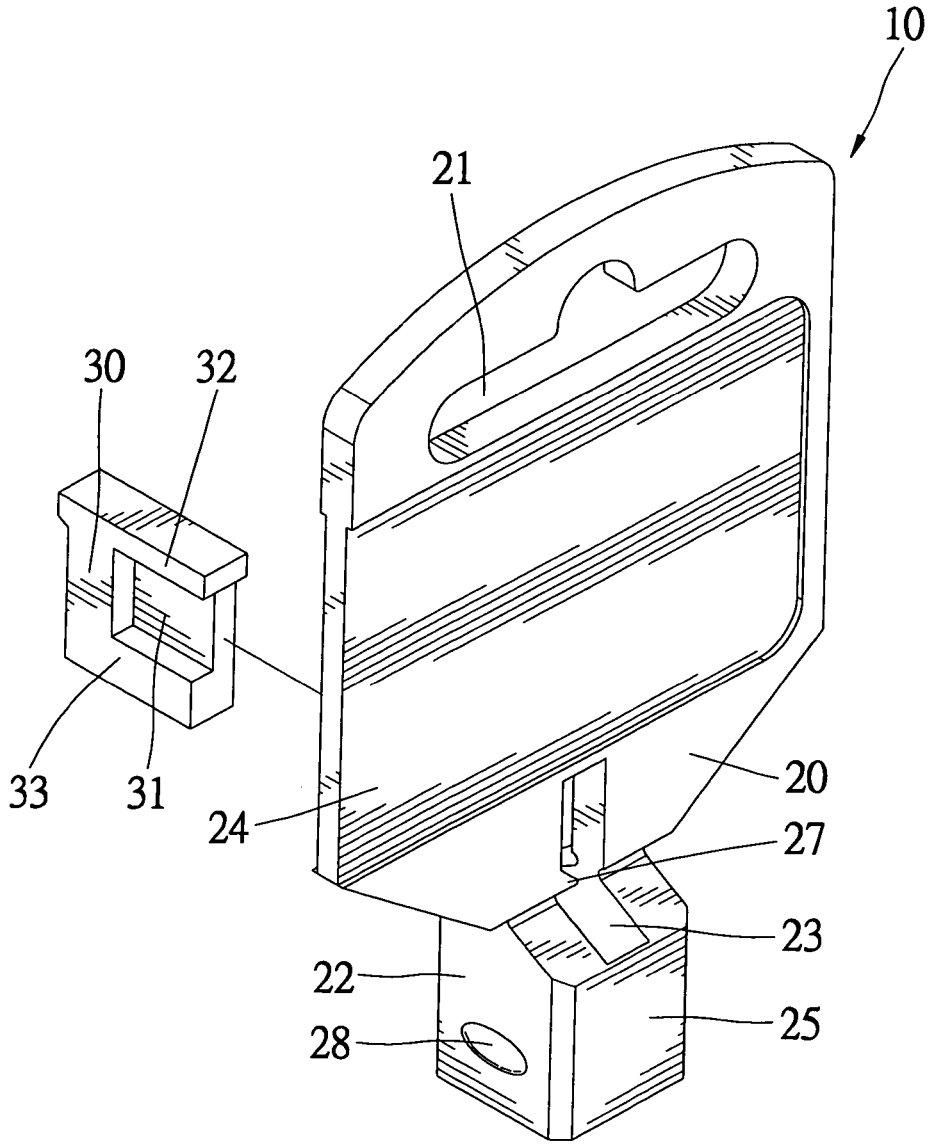
FIG. 6 is a perspective view of a hanger according to a second embodiment of the present invention.
Figure 7:
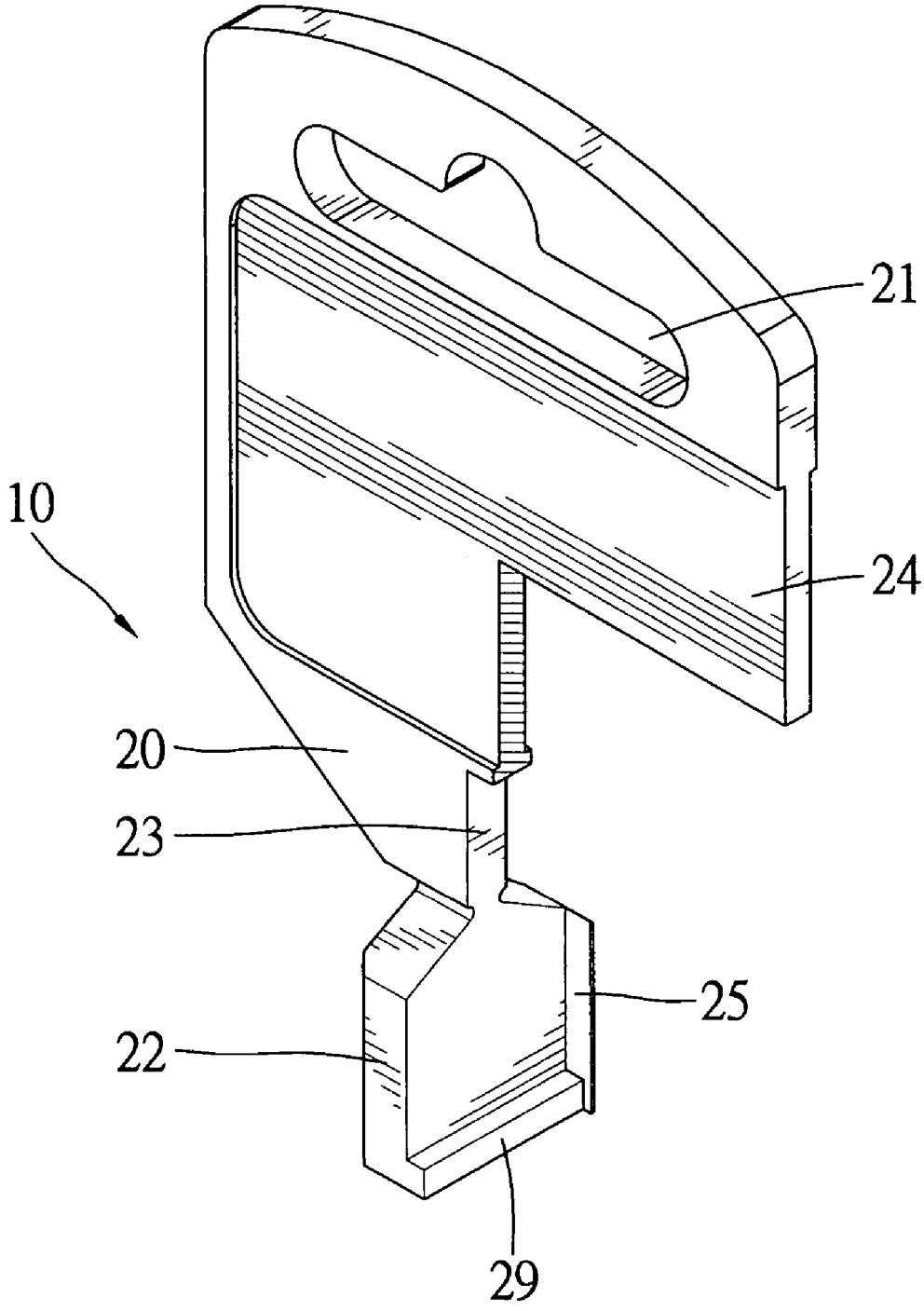
FIG. 7 is a cut-away view of the hanger shown in FIG. 6.

FIGS. 6 and 7 show a hanger according to a second embodiment of the present invention. The second embodiment is identical to the first embodiment except for including a wall 25 extending between the locking elements 22 for avoiding tearing of the locking elements 22 from each other.

Figure 8:
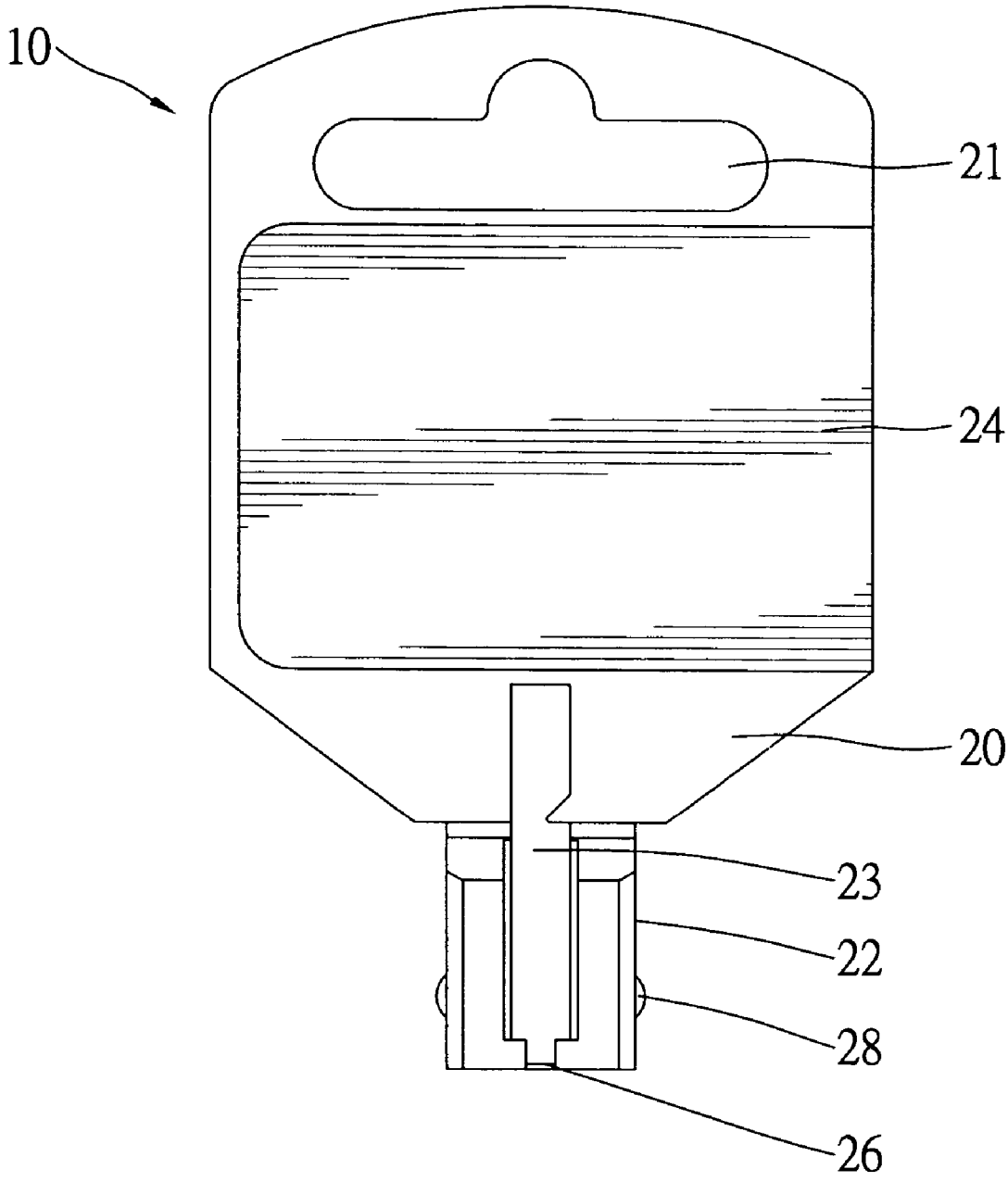
FIG. 8 is a perspective view of a hanger according to a third embodiment of the present invention.
Figure 9:
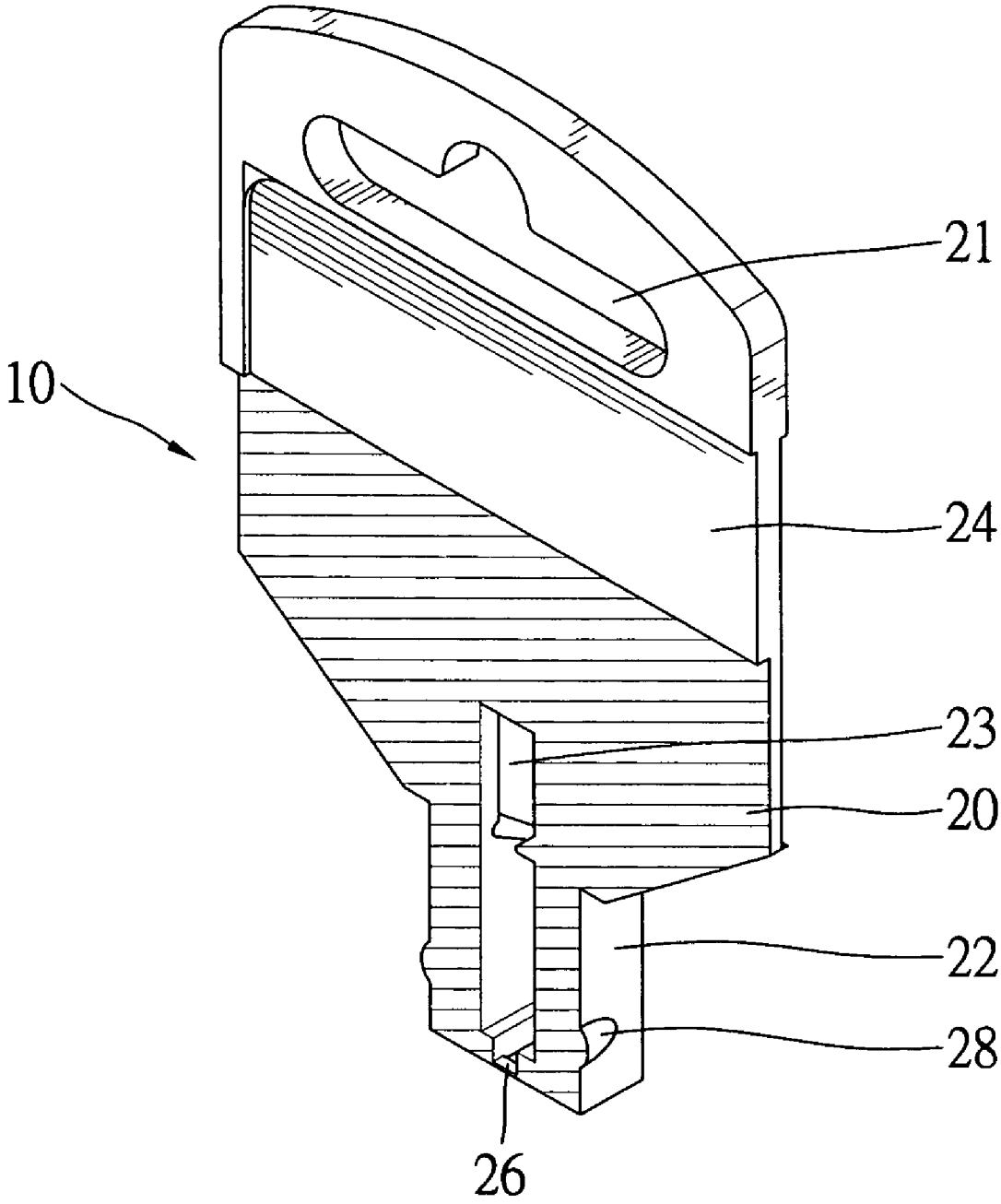
FIG. 9 is a cut-away view of the hanger shown in FIG. 8.
Figure 10:
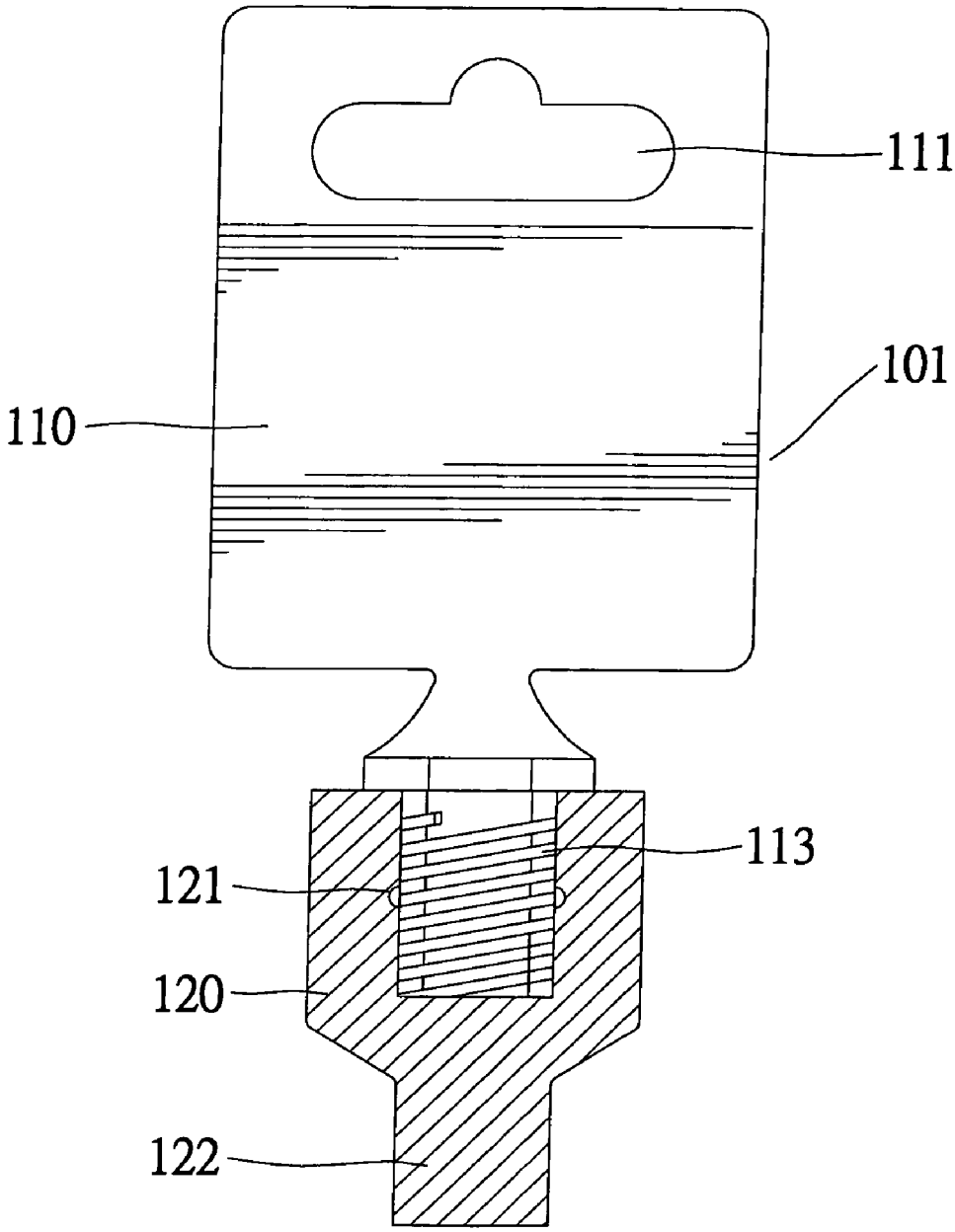
Fig. 10 PRIOR ART
FIG. 10 is a front view of a conventional hanger and a tool that is shown in a cross-sectional view.

FIGS. 8 and 9 show a hanger according to a third embodiment of the present invention. The third embodiment is identical to the first embodiment except for including a floor 26 extending between the locking elements 22 for avoiding tearing of the locking elements 22 from each other.

The present invention has been described via detailed illustration of some embodiments. Those skilled in the art can derive variations from the embodiments without departing from the scope of the present invention. Therefore, the embodiments shall not limit the scope of the present invention defined in the claims.

What is claimed is:

1. A hanger for a tool comprising a recess, the hanger comprising a board that can be hung on an object secured to a wall, two locking elements extending from the board and a key movable between the locking elements to a locking position from a non-locking position, wherein in the non-locking position, the key allows the locking elements to be biased toward each other so that they can be inserted in the recess of the tool, wherein in the locking position, the key prevents biasing of the locking elements toward each other so that they cannot be pulled from the recess of the tool, wherein each of the locking elements comprises a boss formed on an external side for insertion in a groove defined in the wall of the recess.

2. The hanger according to claim 1 comprising a rear wall extending between the locking elements.

3. The hanger according to claim 1 comprising a floor extending between the locking elements.

4. The hanger according to claim 1 wherein the tool is a socket.

5. The hanger according to claim 4 wherein the recess of the socket is a square recess.

6. A hanger for a tool comprising a recess, the hanger comprising a board that can be hung on an object secured to a wall, two locking elements extending from the board and a key movable between the locking elements to a locking position from a non-locking position, wherein in the non-locking position, the key allows the locking elements to be biased toward each other so that they can be inserted in the recess of the tool, wherein in the locking position, the key prevents biasing of the locking elements toward each other so that they cannot be pulled from the recess of the tool, wherein the each of the locking elements comprises a stop formed on an internal side for preventing escaping of the key from the locking elements.

7. The hanger according to claim 6 comprising a rear wall extending between the locking elements.

8. The hanger according to claim 6 comprising a floor extending between the locking elements.

9. The hanger according to claim 6 wherein the tool is a socket.

10. The hanger according to claim 9 wherein the recess of the socket is a square recess.

11. A hanger for a tool comprising a recess, the hanger comprising a board that can be hung on an object secured to a wall, two locking elements extending from the board and a key movable between the locking elements to a locking position from a non-locking position, wherein in the non-locking position, the key allows the locking elements to be biased toward each other so that they can be inserted in the recess of the tool, wherein in the locking position, the key prevents biasing of the locking elements toward each other so that they cannot be pulled from the recess of the tool, wherein one of the locking elements comprises a wedge formed on an internal side for preventing returning of the key to the non-locking position.

12. The hanger according to claim 11 wherein the board comprises an aperture for receiving the object secured to the wall.

13. The hanger according to claim 11 wherein the board comprises a shallow recess for receiving a mark.

14. The hanger according to claim 11 wherein the key comprises a recess for receiving the wedge.

15. The hanger according to claim 14 wherein the key comprises a beam above the recess for abutment against the wedge in order to retain the key in the locking position.

16. The hanger according to claim 11 comprising a rear wall extending between the locking elements.

17. The hanger according to claim 11 comprising a floor extending between the locking elements.

18. The hanger according to claim 11 wherein the tool is a socket.

19. The hanger according to claim 18 wherein the recess of the socket is a square recess.

20. The hanger according to claim 19 wherein the locking elements are parallel to each other for contact with two opposite walls of the square recess.

* * * * *